US010240104B2

(12) United States Patent
Bill

(10) Patent No.: US 10,240,104 B2
(45) Date of Patent: Mar. 26, 2019

(54) AGENT FOR MIXING INTO A SERVICE FLUID FOR A TECHNICAL LAYOUT, CONCENTRATE FOR MIXING INTO A SERVICE FLUID FOR A TECHNICAL LAYOUT, AND THE SERVICE FLUID

(71) Applicant: REWITEC GmbH, Lahnau (DE)

(72) Inventor: Stefan Bill, Wetzlar (DE)

(73) Assignee: REWITEC GMBH, Lahnau (DE)

( * ) Notice: Subject to any disclaimer, the term of this patent is extended or adjusted under 35 U.S.C. 154(b) by 0 days.

(21) Appl. No.: 14/134,853

(22) Filed: Dec. 19, 2013

(65) Prior Publication Data

US 2014/0179569 A1 Jun. 26, 2014

(30) Foreign Application Priority Data

Dec. 21, 2012 (DE) ..... 10 2012 113 070

(51) Int. Cl.
*C10M 173/02* (2006.01)
*C07F 5/04* (2006.01)
(Continued)

(52) U.S. Cl.
CPC ..... *C10M 125/26* (2013.01); *C10M 125/00* (2013.01); *C10M 125/02* (2013.01);
(Continued)

(58) Field of Classification Search
CPC ..... C10M 125/02; C10M 125/06
(Continued)

(56) References Cited

U.S. PATENT DOCUMENTS 5,186,747 A * 2/1993 Mattingly ..... 106/468
5,401,719 A 3/1995 DeBeer
(Continued)

FOREIGN PATENT DOCUMENTS

CN 101063061 A 10/2007
DE 1644971 A1 12/1970
(Continued)

OTHER PUBLICATIONS

Database WPI; Week 197943; Thomson Scientific, London, GB; AN 1979-78068B, XP002719484, & JP S54 118453 (Janome Sewing Machine Co Ltd) Sep. 13, 1979.
(Continued)

*Primary Examiner* — Prem C Singh
*Assistant Examiner* — Francis C Campanell
(74) *Attorney, Agent, or Firm* — Marshall, Gerstein & Borun LLP

(57) ABSTRACT

The invention concerns an agent for mixing into a service fluid for a technical layout, a concentrate for mixing into a service fluid for a technical layout, and a service fluid. An agent according to the invention contains at least one ingredient A chosen from the group of three-layer silicates, at least one ingredient B chosen from the group consisting of bentonites, pyrogenic silicic acids, and talc, and graphite. Thanks to an agent according to the invention, a concentrate according to the invention, and a service fluid according to the invention, the detachment of the lubricating film on the surfaces of working components of a technical layout that are moving relative to each other is prevented in a reliable manner. This is accomplished in particular by a smoothing of the surfaces, accompanied by a reduction of the frictional coefficient and the steady-state temperature of the working components. Moreover, it is ensured that the ingredients of the agent according to the invention, the concentrate accord-
(Continued)

ing to the invention, and the service fluid according to the invention do not agglomerate, so that they can pass through the filters of the technical layout, such as a wind power plant transmission or an internal combustion engine.

8 Claims, 5 Drawing Sheets

(51) Int. Cl.
*C10M 125/26* (2006.01)
*C10M 125/00* (2006.01)
*C10M 125/02* (2006.01)

(52) U.S. Cl.
CPC ... *C10M 2201/02* (2013.01); *C10M 2201/041* (2013.01); *C10M 2201/103* (2013.01); *C10M 2201/105* (2013.01); *C10M 2203/1006* (2013.01); *C10N 2220/022* (2013.01); *C10N 2220/082* (2013.01); *C10N 2230/06* (2013.01); *C10N 2230/54* (2013.01); *C10N 2240/04* (2013.01)

(58) Field of Classification Search
USPC ..... 508/113, 148, 126
See application file for complete search history.

(56) References Cited

U.S. PATENT DOCUMENTS

| | | | | |
|---|---|---|---|---|
| 6,228,813 | B1 | 5/2001 | Yabe et al. | |
| 2010/0105583 | A1* | 4/2010 | Garmier | C10M 169/04 508/155 |
| 2010/0298180 | A1 | 11/2010 | Patel et al. | |
| 2011/0140033 | A1* | 6/2011 | Chen et al. | 252/74 |

FOREIGN PATENT DOCUMENTS

| | | | |
|---|---|---|---|
| DE | 20207821 | U1 | 8/2002 |
| DE | 102007002233 | A1 | 7/2008 |
| EP | 615539 | A1 | 9/1994 |
| KR | 1020110108081 | | 5/2011 |
| WO | WO-2009109849 | A1 | 9/2009 |

OTHER PUBLICATIONS

Database WPI; Week 200333; Thomson Scientific, London, GB; AN 2003-351649, XP002719485, & RU 2194742 (TRIBO-Techn Lab Co Ltd) Dec. 20, 2002.

Zhaofeng Chen et al., "Tribological Characteristics of Combined Layered Phosphate and Silicate Additives in Mineral Oil," *Tribology Letters*, vol. 43, pp. 197-203 (2011). XP019923353.

German Office Action in German Application No. 10 2012 113 070.1 dated Mar. 12, 2013.

European Search Report in corresponding EP 13 19 4949 dated Jan. 30, 2014.

German Office Action in German Application No. 10 2012 113 070.1 dated Dec. 4, 2014.

German Office Action in German Application No. 13 194 949.7 dated May 22, 2015.

Chinese Office Action in Chinese Application No. 201310714079.X dated Apr. 15, 2015.

Search Report in corresponding Chinese Application No. 201310714079X dated Apr. 7, 2015. (English Translation).

B.K. Prasad, Influence of Suspended Talc Particles in Oil and Nature of Material Microconstituents on Sliding Wear Characteristics of Cast Iron and Zinc-based Alloy, Canadian Metallurgical Quarterly, vol. 48, No. 4, pp. 455-464 (2009).

* cited by examiner

A B

AGENT FOR MIXING INTO A SERVICE FLUID FOR A TECHNICAL LAYOUT, CONCENTRATE FOR MIXING INTO A SERVICE FLUID FOR A TECHNICAL LAYOUT, AND THE SERVICE FLUID

CROSS-REFERENCE TO RELATED APPLICATION

The present application claims the benefit of priority to German Patent Application 10 2012 113 070.1 filed Dec. 21, 2012, which is incorporated herein by reference in its entirety.

TECHNICAL FIELD

The present invention concerns an agent for mixing into a service fluid for a technical layout, especially a lubricant for a transmission or a lubricant or fuel for an internal combustion engine. Furthermore, it relates to a concentrate for mixing into a service fluid for a technical layout and a service fluid for a technical layout.

BACKGROUND

In many technical layouts, such as transmissions for wind power plants, ships or motor vehicles, in automotive or industrial transmissions, in internal combustion engines, but also in bearings, cylinder liners, turbochargers or other mechanical systems, mechanical parts are usually in motion relative to each other.

Friction occurs during the relative motion between such parts. The resulting frictional losses consist, on the one hand, in wearing of the surfaces rubbing together of the parts moving relative to each other, which can lead directly to damage and to failure of the technical layouts. On the other hand, frictional heat is produced, which can lead to uncontrolled expansion of the parts. On the whole, frictional losses result in diminished performance or worsened efficiency of the technical layout. Furthermore, damage to the moving parts can occur, and as a consequence erosion or corrosion, for example.

In order to prevent or at least delay the wear resulting from friction, service fluids are used in technical layouts that are supposed to reduce the friction between the parts. For example, one customarily uses for this greases or lubricants. These separate the parts moving relative to each other by wetting their surfaces with a lubricating or sliding film. Many greases and lubricants have been developed for this in the most diverse compositions and configurations.

Despite this use of greases or lubricants, wear still occurs rather often between parts moving relative to each other because the lubricating or sliding film can become detached under pressure and/or at increasing temperature. The frictional losses increase, which is especially disadvantageous in technical layouts that are exposed to high or permanent loads, such as wind power plants, ships, or industrial plants. The lifetime of such technical layouts is therefore limited. The operating and maintenance expenses are correspondingly high.

To deal with this problem, agents or aggregates have been developed that are mixed in with the service fluid. These are supposed to prevent the lubricating or sliding film between the parts moving relative to each other from breaking down or becoming detached. One such agent is known, for example, from DE 10 2004 063 835 A1. It comprises muscovite, $K\{Al_2(OH)_2[AlSi_3O_{10}]\}$, and kaolinite, $Al_2(OH)_4[Si_2O_5]$. As further components, a sodium magnesium hydroxide silicate $Na_2Mg_4Si_6O_{16}(OH)_2$ can be provided, and also optionally an abrasive, such as lizardite, $Mg_3(OH)_4[Si_2O_5]$. The agent is essentially suitable for mixing in with a service fluid of a technical layout, whereupon the surface properties of the parts are altered, in particular, the friction between the parts moving relative to each other is supposed to be reduced in order to improve the lifetime of the technical layout.

However, the production of such an agent is relatively costly. Thus, one must first fragment the minerals provided as the components in rough manner and then in fine manner, until the desired grain size is achieved. After a selection of the resulting particles in terms of density, weight and grain size, the unwanted material admixtures are removed. Only then can the powderlike aggregate be mixed in with the service fluid. Another problem is that the described aggregate after being mixed in with service fluids such as motor or transmission oil will usually become sedimented and therefore is hard to dispense. What is more, an agglomeration of the various ingredients sometimes occurs, which means that the aggregate may get stuck on filter elements of the technical layout, i.e., the aggregate is separated from the service fluid and therefore can no longer perform its task. Furthermore, the pores of the filters can become clogged, so that they need to be cleaned or replaced more often, which further increases the operating and maintenance expenses. Yet filter elements are necessary in many technical layouts in order to guarantee a permanent cleaning of the service fluid. Thus, the known aggregate is extremely impractical and complicated in its handling.

SUMMARY OF THE INVENTION

The problem of the invention is therefore to overcome these and other drawbacks of the prior art and to create an agent for mixing in with a service fluid of a technical layout with which the friction between the parts of the technical layout moving relative to each other is reduced. Moreover, the agent should be dispersed in permanent and stable manner in the service fluid, and the ingredients of the agent should not get stuck on any filter elements present in the technical layouts and thereby become separated from the service fluid. Furthermore, the agent should be easy and cheap to produce and handle, and as environment-friendly as possible.

The principal features of the invention are indicated in the claims.

The problem is solved by an agent for mixing in with a service fluid for a technical layout, containing:

- at least one ingredient A chosen from the group of the three-layer silicates,
- at least one ingredient B chosen from the group consisting of bentonites, pyrogenic silica, and talc, and
- graphite.

The use of the agent according to the invention as an aggregate in a service fluid for a technical layout has shown surprisingly that that the friction between the parts of the layout moving relative to each other is distinctly reduced as compared to tests that were carried out with service fluids having no aggregate according to the invention. It was found that the ingredients of the agent according to the invention cause an alteration, especially a smoothing, of the surfaces of the parts moving relative to each other, i.e., the roughness of the surfaces decreases thanks to mixing in the agent according to the invention. The relatively soft ingredients of the agent according to the invention get in between the surfaces of the parts moving relative to each other. Here, they react due to the temperatures prevailing there (hot spots) and the resulting pressure with the surfaces of the parts, the silicate particles becoming bound to the surfaces of the parts and/or becoming embedded therein. The surfaces are smoothed, which results in an improved load distribution between the parts.

Therefore, the level of friction is reduced overall, especially the frictional moments $M_R$ and the roughness parameters, namely, the average surface roughness $R_z$ and the average peak to valley height $R_a$ of the surfaces of the parts moving relative to each other. With the reduction in friction between the parts, they no longer become overly heated. The steady state temperature of the parts moving relative to each other and the temperature of the service fluid decrease. All of this has the result that the viscosity of the service fluid is not reduced as is customary during the operation of the technical layout, so that the adhesion of the service fluid to the surface of the parts moving relative to each other is improved. Therefore, a relatively thick and stable lubricating or sliding film can form between the parts, which can neither become detached nor broken down, even under extreme and ongoing loading. Consequently, one achieves with the agent according to the invention a distinct improvement in the performance and the lifetime of a technical layout, especially for its tribological systems.

The agent according to the invention furthermore can be dispersed in permanent and stable manner in the service fluid, i.e., the settling behavior of the ingredients of the agent according to the invention in the service fluid is distinctly reduced. Therefore, economical long-term stable dispersions can be produced, because the action of the agent according to the invention is assured over a long time. Thus, the agent according to the invention is distinguished by a high reliability. On the whole, a lasting good lubrication of a technical layout or a tribological system with low friction is assured.

Furthermore, no agglomeration occurs within the service fluid of the ingredients contained in the agent according to the invention, i.e., the ingredients of the agent do not get stuck on any available filter elements of the technical layouts and therefore are not separated from the service fluid. The layout can be operated reliably in permanent manner. Maintenance and repair intervals become substantially longer, which has extremely favorable effects on the operating costs.

The agent according to the invention, which is preferably pastelike, can be mixed in with a lubricant, for example, of a transmission, especially a wind power plant transmission or a ship transmission, or a lubricant or fuel for an internal combustion engine.

The mixing in with a service fluid of a technical layout can comprise the following steps, for example: in a first step, a defined quantity of the paste is mixed with a likewise defined quantity of a carrier material, so that a concentrate is formed. This is then added in a predefined quantity to a likewise defined quantity of a service fluid, in order to achieve a given concentration of the agent according to the invention relative to the total weight of the service fluid contained in the layout. The carrier material of the concentrate can be a suitable lubricant. Depending on the application, however, one will preferably use the service fluid that is used in the technical layout as the carrier material. Consequently, to make the concentrate, one can either use an additional quantity of the service fluid or remove a defined quantity from the technical layout and prepare the concentrate with this, then returning it to the layout. Here as well the agent according to the invention is present in such a concentration that a predefined end concentration specific to the layout and the service fluid (in percent by weight, wt. %) is achieved, relative to the total weight of the service fluid contained in the layout.

The mixing in of the agent according to the invention with a service fluid can be done prior to the first-time use of a technical layout. But it is also possible to use the agent according to the invention in already existing layouts by mixing it in afterwards with the service fluid.

Advantageously, the agent according to the invention shows its friction-reducing action during the ongoing operation of a technical layout. Thus, a costly pretreatment of the parts moving relative to each other prior to their installation in the technical layout is not required, which has a favorable impact on the production costs of the layout.

Three-layer silicates are distinguished by their relatively low hardness. This is especially advantageous because they are easily smeared and cling well to the surface of the parts moving relative to each other—especially under the action of friction and/or pressure.

Natural sodium bentonites, for example, are well suited for the conditioning of the pastes according to the invention.

Pyrogenic silica typically consist of particles with diameter of 5 nm-50 nm, wherein the specific surface usually lies in the range of 50 $m^2/g$ to 600 $m^2/g$. They are suitable, for example, as thickeners and have an abrasive action with respect to metal surfaces. Thanks to their size distribution, furthermore, the particles of pyrogenic silica are suited to filling in the grooves or striae of a metal surface. The grooves or striae need not have been produced by wear, but instead can also represent manufacturing-related material flaws. Furthermore, pyrogenic silica also function, for example, as thixotropic agents, as well as anti-sedimentation agents, i.e., the pyrogenic silica helps the agent to be dispersed in permanent and stable manner in the service fluid.

The layered silicate talc, $Mg_3(OH)_2[Si_2O_5]_2$, is distinguished in particular by a greasy feel and an unusually low hardness for a silicate. These properties are likewise advantageous in regard to the agent according to the invention. Furthermore, due to its inertness, talc can also be used as a filler, for example.

Graphite is suitable because of its greasy feel as a solid lubricant. This property and the fact that it is a strong colorant make it an advantageous ingredient of the agent according to the invention.

On the whole, the agent according to the invention is especially suitable for altering the surface structure of parts moving relative to each other in a technical layout so that surface roughness is smoothed out. This accomplishes a reduction in friction between the parts moving relative to each other of the technical layout. The agent according to the invention prevents in a reliable and long-lasting manner a lubricating or sliding film adhering to the parts moving relative to each other from breaking down or becoming detached, so that frictional losses can be reduced overall.

One embodiment of the agent according to the invention specifies, as ingredient A, a natural or chemically modified muscovite and/or a natural or chemically modified phlogopite.

Natural muscovite and natural phlogopite are advantageously very resistant to high temperatures, water, acids and bases, they have low coefficients of thermal expansion, and are distinguished by a comparatively low hardness, so that the presence of at least one of these natural micas advantageously influences the properties of the agent according to the invention.

Advantageously, natural muscovite and natural phlogopite can be chemically modified, so that the properties of these micas can be adapted to the application. In this way, the characteristics of the agent according to the invention can be adjusted precisely and specific to the application.

In another embodiment of the agent according to the invention, the chemically modified phlogopite is a phlogopite modified with aminosilane. In this was, the properties of the agent according to the invention can be further specified and adapted to the given conditions that need to be met for a technical layout. Alternatively, the chemically modified phlogopite can also be provided with a surface coating suitable for polyamide.

Such chemically modified phlogopites are used, for example, as a filler in the agent according to the invention. They can be obtained in various particle sizes, so that a corresponding choice of the particle size can influence, for example, the consistency of the agent. Moreover, the filter passability of the agent can be adjusted accordingly.

A further embodiment of the agent according to the invention has the bentonite chemically modified.

In chemically modified bentonites, the inorganic cations of the intermediate layers are exchanged for polar, organic molecules, such as quaternary ammonium cations. Thanks to this hydrophobization, the bentonite can swell up in nonpolar liquids. This can be advantageous when predominantly nonpolar solvents are used in the preparation of the agent according to the invention.

Such bentonite derivatives, also known as organobentonites, can serve advantageously in the agent according to the invention as thixotropic thickening agents and/or as anti-sedimentation agents.

Another embodiment of the agent according to the invention has the pyrogenic silica chemically aftertreated. In this way, the silica can be made hydrophobic, which is advantageous in that such a silica can be effective as an antilocking agent, that is, to prevent the sticking together of two surfaces.

Yet another embodiment of the agent according to the invention is characterized by at least one additional ingredient C, chosen from the group consisting of industrial carbon black, organic carbonates, water and dispersant.

Industrial carbon black has primarily a coloring function in the agent according to the invention.

In particular, when the agent according to the invention contains bentonite, the presence of a swelling agent or activator is required, because the bentonite or bentonites first need to be slurried. This swelling agent or activator can be, e.g., an organic carbonate, optionally mixed with water.

Especially suitable as the dispersant are organomodified siloxanes. Alternatively, modified polyethers can be used.

The dispersants ensure that a stable dispersion is provided, i.e., a sedimentation of the ingredients of the agent according to the invention that are dispersed in the carrier and/or service fluid is effectively prevented. This is important not only for the reliable and long-lasting action of the agent according to the invention in the technical layout, but also in view of the storage and transport of the agent according to the invention. In particular in the case of large drums of the agent according to the invention one must prevent a sedimentation over a lengthy period of time. Otherwise, a further dispersing would be required just before pouring the agent according to the invention into a transmission, for example, or in an internal combustion engine. But this entails considerable time and expense, especially in the case of large drums, and so it is not really an option. The agent according to the invention, on the other hand, can be mixed in with the service fluid—either directly or via a concentrate—with no pretreatment, even after a lengthy storage time.

Another sample embodiment has propylene carbonate as the organic carbonate. This is especially advantageous as a swelling agent for the bentonite or bentonites, especially in combination with water.

An important modification of the invention calls for the ingredients A, B and C having particle sizes less than 25 μm, preferably less than 8 μm, especially preferably less than 2 μm.

In this way, it is possible to adjust or dictate the particle sizes within the service fluid so that the ingredients of the agent according to the invention do not get stuck in a filter of the technical layout, such as is used for example for the cleaning of the service fluid. The particle size of the agent according to the invention is instead smaller than the pore diameter of the typically used filter elements. The particle sizes of all the ingredients A, B and C can therefore be chosen such that the particles are all filter-passable. Thus, the agent according to the invention can be used even in transmissions and plant parts outfitted with filter systems, because it is not separated from the service fluid. The filters have a distinctly longer service life and do not have to be cleaned or replaced.

Furthermore, thanks to the particle sizes of the ingredients A, B and C as specified by the invention, an agglomeration of the particles is effectively prevented. This is especially advantageous because both the filtering out of particles that are too large, i.e., not able to pass the filter, and the filtering out of agglomerates not able to pass the filter has the consequence that the ingredients of the agent according to the invention are separated from the service fluid, so that there is a loss of effectiveness of the agent according to the invention.

Besides the quality of the ingredients A, B, and C contained in the agent according to the invention, the choice of the particle size of the ingredients A, B, and C is thus important to guarantee a long-lasting reduction of the friction between the parts of the technical layout moving relative to each other.

Moreover, the problem is solved by a concentrate for mixing in with a service fluid for a technical layout, containing a carrier and an agent according to at least one of the previously specified embodiments.

The carrier can be a solid or a liquid. However, it is especially advantageous to select a liquid carrier, so that the concentrate according to the invention is present in liquid form. Depending on the choice of the carrier and the agent—regardless of the steady-state temperature of the surfaces of the parts moving relative to each other—different viscosities of the concentrate according to the invention can be adjusted.

The above described benefits of the agent according to the invention likewise hold for the concentrate according to the invention. This can be cheaply prepackaged and adjusted to the most diverse needs of technical layouts. Furthermore, the handling is simplified for the operator of the technically layout, because the mixing in with the already present service fluid can be done quickly and conveniently.

A concentrate according to the invention advantageously present in liquid form can be mixed in, for example, with a lubricant of a transmission, especially a wind power plant transmission, or with a lubricant or fuel of an internal combustion engine.

The mixing in is done in the same way as the replenishing of the particular lubricant or fuel. One only needs to make sure that the quantity of the concentrate according to the invention is mixed in with the service fluid—in terms of the total weight of the service fluid contained in the layout—so that a given end concentration (in percent by weight, or wt. %) of the agent according to the invention that is contained in the concentrate according to the invention, specific to the layout and the service fluid, is achieved. Since it can be prepackaged, the handling is extremely simple and reliable.

In one embodiment of the concentrate according to the invention, the agent is dispersed in the carrier.

During the dispersing, the carrier can advantageously be heated in order to lower the viscosity and thus accelerate the dispersing process on the one hand and accomplish the most ideal dispersion on the other hand. Achieving a stable and long-lasting dispersion of the agent according to the invention in the carrier ensures that the agent according to the invention can work reliably, so that the friction between the parts of the technical layout moving relative to each other is reduced.

Another embodiment is characterized in that the carrier is an oil.

Depending on the application, the carrier can be, for example, a mineral oil, an ester oil or a silicone oil. Different viscosities of the oil are conceivable. Furthermore, mixtures of various oils that are ideally miscible with each other can be used as the carrier.

Advantageously, the carrier is ideally miscible with the service fluid, i.e., the lubricant or fuel in which the concentrate is supposed to be mixed.

Especially in the case of large drums, one must avoid in the long term an agglomeration and sedimentation of the ingredients of the agent according to the invention that are dispersed in an oil. Otherwise, a repeated dispersion is required just prior to pouring the concentrate according to the invention into, say, a transmission or an internal combustion engine, but this entails substantial time and expense. However, this is effectively avoided with an agent according to the invention as aggregate in a service fluid.

To provide a stable dispersion, the presence of at least one of the aforementioned dispersants is particularly advantageous, such as at least one modified siloxane or at least one modified polyether.

In another embodiment of the concentrate according to the invention, the carrier is the service fluid.

This can be the case, for example, when the concentrate is supposed to be prepared tailor-made for mixing in with a service fluid for a predetermined technical layout. Furthermore, this embodiment is especially advantageous if it is known that the service fluid already contained in the technical layout is not ideally miscible with standard carriers used.

Moreover, the problem is solved by a service fluid with an agent according to at least one of the above described sample embodiments or a concentrate according to at least one of the above described sample embodiments.

Advantageously, an agent according to the invention or a concentrate according to the invention can be mixed in with the entire volume of service fluid to be poured into a technical layout before the service fluid is poured into the technical layout. This can be especially advantageous when the pouring of a lubricant or fuel into the technical layout—and consequently also the mixing in of an agent or concentrate according to the invention with the service fluid—involves considerable expense and/or the technical layout has not yet been placed in service.

Further features, details and benefits of the invention shall appear from the wording of the claims as well as the following description of sample embodiments with the help of the drawings.

Figure 1:
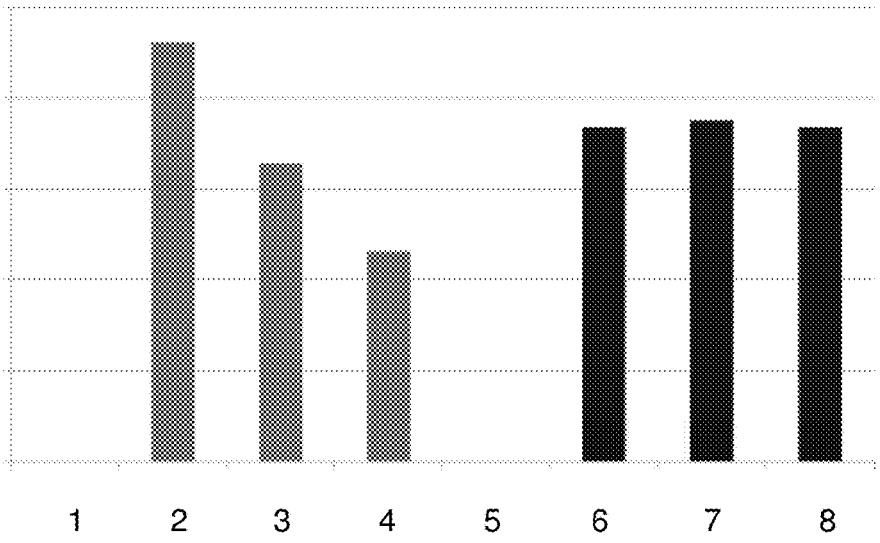
FIG. 1 shows with the help of rolling contact wear investigations the reduction in the frictional moments MR (in %) in an experimental technical layout (2-disk test stand) by adding a concentrate according to the invention to the service fluid used in the layout. Compared to this are measurements in the same technical layout with the same service fluid, but without the concentrate according to the invention. The service fluid is a conventional oil, namely Oil 1: Agip Blasia 150, low viscosity ISO VG 150.

Oil 2: Agip Blasia SX 320, high viscosity ISO VG 320.

As the concentrate, a carrier was used that was provided with an agent according to the invention per one of sample embodiments 1, 2, 3 or 4.

The following measurements were taken:

1: Oil 1 without additive,
2: Oil 1 with 0.2 wt. % of the concentrate per sample embodiment 1,
3: Oil 1 with 0.2 wt. % of the concentrate per sample embodiment 2,
4: Oil 1 with 0.2 wt. % of the concentrate per sample embodiment 3,
5: Oil 2 without additive,
6: Oil 2 with 0.2 wt. % of the concentrate per sample embodiment 1,
7: Oil 2 with 0.2 wt. % of the concentrate per sample embodiment 2,
8: Oil 2 with 0.2 wt. % of the concentrate per sample embodiment 4.

Figure 2:
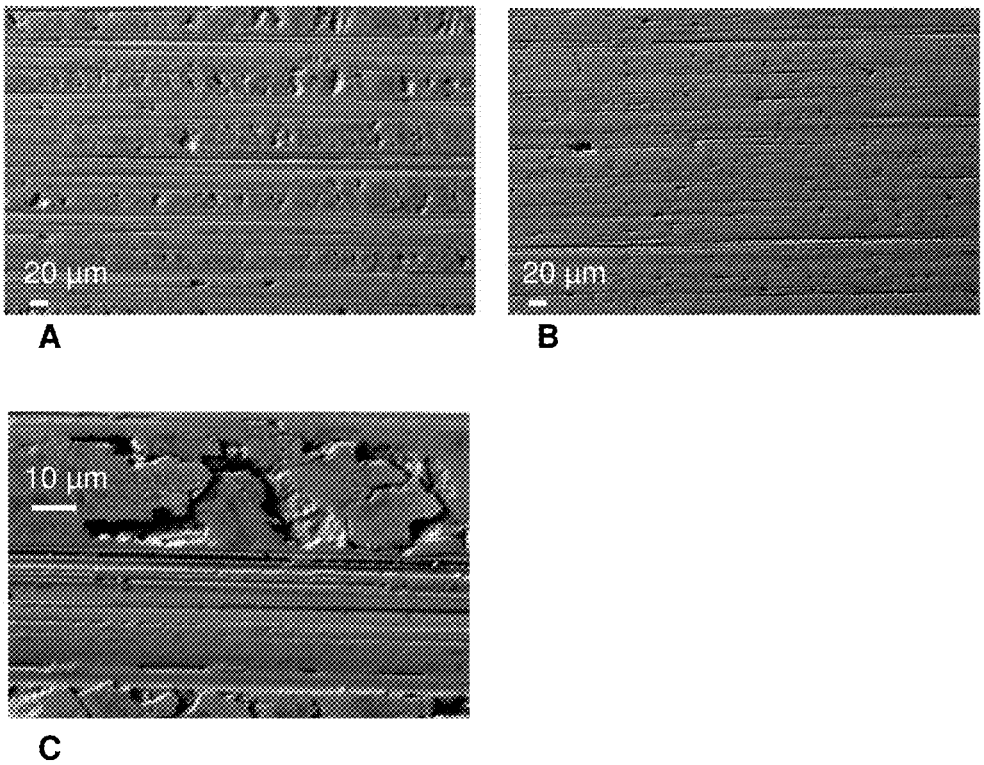

FIG. 2 shows scanning electron microscope photographs of the surfaces of the sample body used in the 2-disk test stand after conducting the rolling contact wear investigations. Test duration: 20 h 20 min.

The following photographs are shown:

A, C: surface of the sample body after loading, using the untreated conventional oil 1,
B: surface of the sample body after loading, using oil 1 with 0.2 wt. % of the concentrate per sample embodiment 1.

Figure 3:
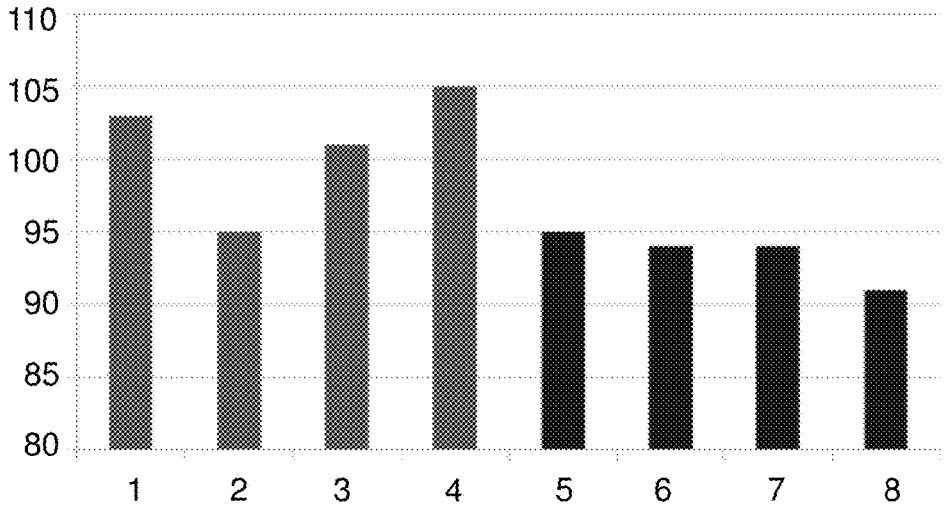

FIG. 3 shows the steady-state temperature (in ° C.) of the sample body after conducting the rolling contact wear tests on the 2-disk test stand with and without adding of a concentrate according to the invention per one of sample embodiments 1, 2, 3 or 4 to the untreated oils 1 or 2 (Oil 1: Agip Blasia 150, low viscosity ISO VG 150; Oil 2: Agip Blasia SX 320, high viscosity ISO VG 320).

The following measurements were taken:

1: Oil 1 without additive,
2: Oil 1 with 0.2 wt. % of the concentrate per sample embodiment 1,
3: Oil 1 with 0.2 wt. % of the concentrate per sample embodiment 2,
4: Oil 1 with 0.2 wt. % of the concentrate per sample embodiment 3,
5: Oil 2 without additive,
6: Oil 2 with 0.2 wt. % of the concentrate per sample embodiment 1,
7: Oil 2 with 0.2 wt. % of the concentrate per sample embodiment 2,
8: Oil 2 with 0.2 wt. % of the concentrate per sample embodiment 4.

Figure 4:
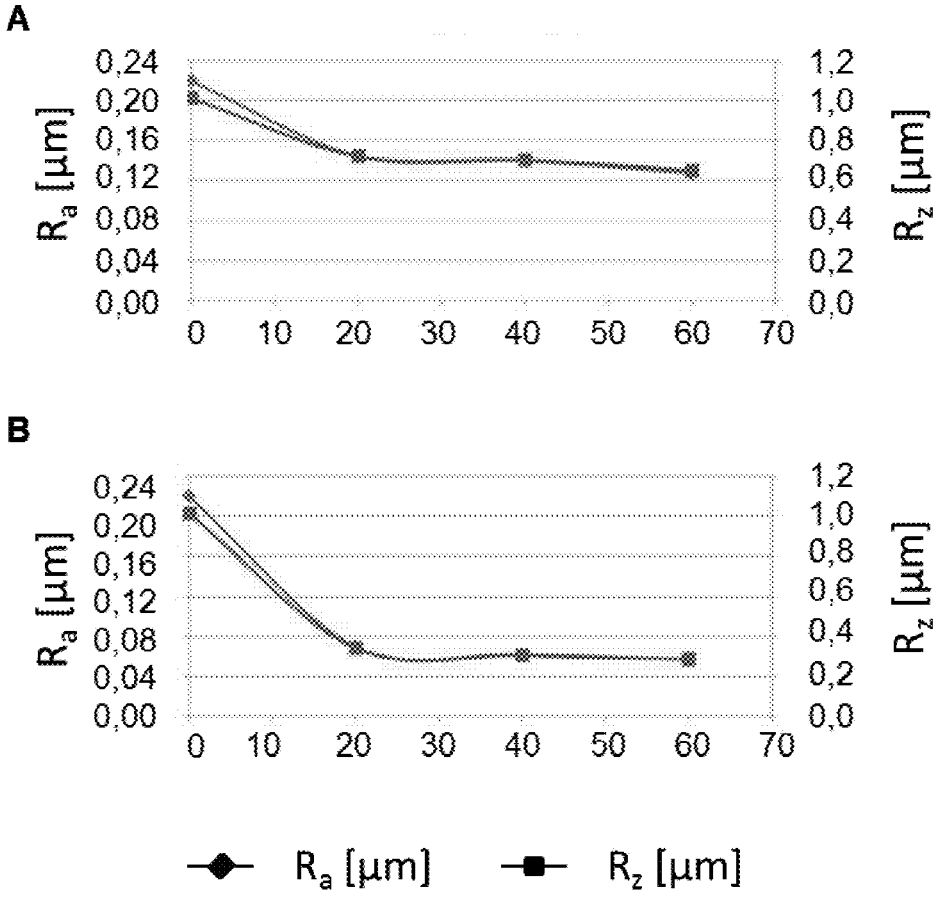

FIG. 4 shows the change in the roughness parameters, namely, the average surface roughness $R_z$ and the mean peak to valley height $R_a$ of the surfaces of the sample body after conducting the rolling contact wear tests on the 2-disk test stand.

The following results were obtained:

Abscissa: running time (in h).

A: Oil 2 without additive,

B: Oil 2 with addition of 0.2 wt. % of the concentrate per sample embodiment 4.

Figure 5:
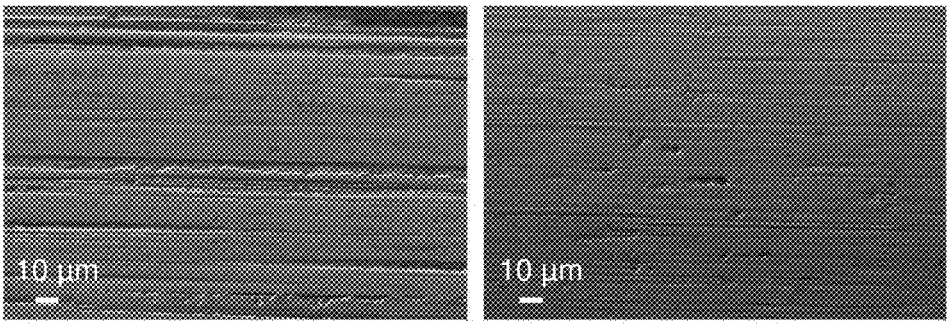

FIG. 5 shows scanning electron microscope photographs of the surfaces of the sample body after rolling contact wear investigations on the 2-disk test stand. Test duration: 60 h.

The following photographs are shown:

A: surface of the sample body after loading, using oil 2,

B: surface of the sample body after loading, using oil 2 with addition of 0.2 wt. % of the concentrate per sample embodiment 4.

DETAILED DESCRIPTION OF THE INVENTION

For the following specific sample embodiments, the following ingredients are used:

Ingredient A

Mica: —MICA SFG70, a natural muscovite with grain size 70, per chemical analysis consisting of: 51.5% $SiO_2$, 27.0% $Al_2O_3$, 10.0% $K_2O$, 0.4% CaO, 2.9% $Fe_2O_3$, 2.8% MgO, 0.4% $TiO_2$, 0.2% $Na_2O$, 0.2% $P_2O_5$, 0.03% MnO, 4.57% roasting loss Trefil® 1232, a natural phlogopite coated with an aminosilane, per chemical analysis consisting of: 41% $SiO_2$, 10% $Al_2O_3$, 26% MgO, 2% CaO, 10% $K_2O$, 8% $Fe_2O_3$, 2% $H_2O$, 1% F Ingredient B a) Bentonite: Claytone® 40, an organobentonite b) Pyrogenic silica: —Aerosil® 200, a pyrogenic hydrophilic silica, specific surface 200 $m^2/g$ Aerosil® OX50, a pyrogenic hydrophilic silica, specific surface 50 $m^2/g$ c) Talc Ingredient C a) Graphite: Carbopower® SGN 18, a spherical natural graphite b) Industrial carbon black: Special black (carbon black)

c) Organic carbonate: Propylene carbonate d) Water e) Dispersant: TEGOPREN® 6875, an organomodified siloxane TEGOMER® DA 646, a modified polyether For example, the ingredients A, B and C as well as the carrier are used in the concentrates according to the invention in amounts indicated in Table 1.

TABLE 1

Sample specifications for the amounts of ingredients A, B, and C and carrier contained in the concentrates according to the invention.

| Ingredient | | Quantity | Preferred quantity |
|---|---|---|---|
| A | Trefil ® 1232 | 220-500 g | 360 g |
| A | MICA SFG70 | 220-500 g | 360 g |
| B | Bentonite | 50-300 g | 120 g |

TABLE 1-continued

Sample specifications for the amounts of ingredients A, B, and C and carrier contained in the concentrates according to the invention.

| Ingredient | | Quantity | Preferred quantity |
|---|---|---|---|
| B | Pyrogenic silicic | 65-290 g | 160 g |
| B | Talc | 220-500 g | 500 g |
| C | Carbopower ® SGN 18 | 5-80 g | 30 g |
| C | Special black (carbon black) | 1-4 g | 2 g |
| C | Propylene carbonate | 15-40 g | 25 g |
| C | Water | 1.0-2.5 g | 1.25 g |
| C | TEGOPREN ® 6875 | 3-30 wt. %* | 10.0 wt. %* |
| C | TEGOMER ® DA 646 | 3-30 wt. %* | 10.0 wt. %* |
| Carrier | White oil | 2000-10,0000 g | 5000 g |

*in terms of the total weight of all solids contained in the concentrate

General Protocol for the Preparation of a Concentrate According to the Invention with Use of an Agent According to the Invention In a first step, an agent according to the invention is prepared by wet grinding in an agitator ball mill or bead mill at least one ingredient A with at least one ingredient B and at least graphite as ingredient C, thereby preadjusting the desired particle size—taking into account the filter pore size of the technical layout in whose service fluid the agent or concentrate according to the invention is supposed to be mixed in. The so obtained agent according to the invention is typically in the form of a paste.

In a second step, there is added to the agent according to the invention which is present in the agitator ball mill or bead mill a carrier in the form of a white oil previously heated in a dissolver to 50° C. to 70° C. (viscosity=68 $mm^2/sec$). Alternatively, the white oil can also be heated directly in the agitator ball mill or bead mill to 50° C. to 70° C. In order to prepare a stable dispersion, the agent according to the invention and the white oil are stirred in the agitator ball mill or bead mill at a temperature between 50° C. and 70° C. The so obtained concentrate according to the invention, usually in liquid form, is easy to handle and can be used at once. Because a stable dispersion exists, storage is also possible with no problems. Therefore, the concentrate according to the invention can also be decanted in smaller amounts at a later time, without having to disperse it once again, such as by shaking the drum.

Sample Embodiment 1

160 g Aerosil® 200, 360 g Trefil® 1232, 360 g MICA SFG70, 30 g Carbopower® SGN 18 and 2 g Special black (carbon black) are ground in a bead mill to a particle size of 20 μm. From the agent so obtained—as described in the general protocol—the concentrate is prepared with addition of 5000 g of white oil (viscosity=68 $mm^2/sec$).

Sample Embodiment 2

160 g Aerosil® 200, 360 g Trefil® 1232, 360 g MICA SFG70, 30 g Carbopower® SGN 18 and 2 g Special black (carbon black) are ground in a bead mill to a particle size of 5-7 μm. From the agent so obtained—as described in the general protocol—the concentrate is prepared with addition of 5000 g of white oil (viscosity=68 $mm^2/sec$).

Sample Embodiment 3

120 g Claytone® 40, 25 g propylene carbonate, 1.25 g water, 360 g Trefil® 1232, 360 g MICA SFG70, 30 g Carbopower® SGN18 and 2 g Special black (carbon black) are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 4

120 g Claytone® 40, 25 g propylene carbonate, 1.25 g water, 500 g talc, 360 g MICA SFG70, 5 g Carbopower® SGN 18 and 2 g Special black (carbon black) are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 5

120 g Claytone® 40, 25 g propylene carbonate, 1.25 g water, 160 g Aerosil® 200, 500 g talc, 360 g MICA SFG70, 5 g Carbopower® SGN 18 and 2 g Special black (carbon black) are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 6

200 g Aerosil® OX50, 360 g Trefil® 1232, 360 g MICA SFG70, 30 g Carbopower® SGN 18 and 2 g Special black (carbon black) are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 7

120 g Claytone® 40, 25 g propylene carbonate, 1.25 g water, 200 g Aerosil® OX50, 500 g talc, 360 g MICA SFG70, 5 g Carbopower® SGN 18 and 2 g Special black (carbon black) are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 8

120 g Claytone® 40, 25 g propylene carbonate, 1.25 g water, 500 g talc, 360 g MICA SFG70, 5 g Carbopower® SGN 18, 2 g Special black (carbon black) and 350 g TEGOPREN® 6875 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 9

120 g Claytone® 40, 25 g propylene carbonate, 1.25 g water, 160 g Aerosil® 200, 500 g talc, 360 g MICA SFG70, 5 g Carbopower® SGN 18, 2 g Special black (carbon black) and 350 g TEGOPREN® 6875 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 10

120 g Claytone® 40, 25 g propylene carbonate, 1.25 g water, 200 g Aerosil® OX50, 500 g talc, 360 g MICA SFG70, 5 g Carbopower® SGN 18, 2 g Special black (carbon black) and 350 g TEGOPREN® 6875 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 11

160 g Aerosil® 200, 360 g Trefil® 1232, 360 g MICA SFG70, 30 g Carbopower® SGN 18, 2 g Special black (carbon black) ad 270 g TEGOPREN® 6875 are ground in a bead mill to a particle size of 20 μm. From the agent so obtained—as described in the general protocol—the concentrate is prepared with addition of 5000 g of white oil (viscosity=68 $mm^2$/sec).

Sample Embodiment 12

160 g Aerosil® 200, 360 g Trefil® 1232, 360 g MICA SFG70, 30 g Carbopower® SGN 18, 2 g Special black (carbon black) and 270 g TEGOPREN® 6875 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 13

120 g Claytone® 40, 25 g propylene carbonate, 1.25 g water, 360 g Trefil® 1232, 360 g MICA SFG70, 30 g Carbopower® SGN18, 2 g Special black (carbon black) and 270 g TEGOPREN® 6875 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 14

200 g Aerosil® OX50, 360 g Trefil® 1232, 360 g MICA SFG70, 30 g Carbopower® SGN 18, 2 g Special black (carbon black) and 270 g TEGOPREN® 6875 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 15

340 g Aerosil® 200, 540 g MICA SFG70, 30 g Carbopower® SGN 18 and TEGOPREN® 6875 are ground in a bead mill to a particle size of 1 μm. From the agent so obtained—as described in the general protocol—the concentrate is prepared with addition of 5000 g of white oil (viscosity=68 $mm^2$/sec).

Sample Embodiment 16

120 g Claytone® 40, 25 g propylene carbonate, 1.25 g water, 500 g talc, 360 g MICA SFG70, 5 g Carbopower®

SGN 18, 2 g Special black (carbon black) and 350 g TEGOMER® DA 646 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 17

120 g Claytone® 40, 25 g propylene carbonate, 1.25 g water, 160 g Aerosil® 200, 500 g talc, 360 g MICA SFG70, 5 g Carbopower® SGN 18, 2 g Special black (carbon black) and 350 g TEGOMER® DA 646 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 18

120 g Claytone® 40, 25 g propylene carbonate, 1.25 g water, 200 g Aerosil® OX50, 500 g talc, 360 g MICA SFG70, 5 g Carbopower® SGN 18, 2 g Special black (carbon black) and 350 g TEGOMER® DA 646 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 19

160 g Aerosil® 200, 360 g Trefil® 1232, 360 g MICA SFG70, 30 g Carbopower® SGN 18, 2 g Special black (carbon black) and 270 g TEGOMER® DA 646 are ground in a bead mill to a particle size of 20 μm. From the agent so obtained—as described in the general protocol—the concentrate is prepared with addition of 5000 g of white oil (viscosity=68 $mm^2$/sec).

Sample Embodiment 20

160 g Aerosil® 200, 360 g Trefil® 1232, 360 g MICA SFG70, 30 g Carbopower® SGN 18, 2 g Special black (carbon black) and 270 g TEGOMER® DA 646 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 21

120 g Claytone® 40, 25 g propylene carbonate, 1.25 g water, 360 g Trefil® 1232, 360 g MICA SFG70, 30 g Carbopower® SGN18, 2 g Special black (carbon black) and 270 g TEGOMER® DA 646 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 22

200 g Aerosil® OX50, 360 g Trefil® 1232, 360 g MICA SFG70, 30 g Carbopower® SGN 18, 2 g Special black (carbon black) and 270 g TEGOMER® DA 646 are ground in a bead mill to a particle size of 5-7 μm. From the agent so obtained—as described in the general protocol—the concentrate is prepared with addition of 5000 g of white oil (viscosity=68 $mm^2$/sec).

Sample Embodiment 23

340 g Aerosil® 200, 540 g MICA SFG70, 30 g Carbopower® SGN 18 and TEGOMER® DA 646 are ground in a bead mill to a particle size of 1 μm. From the agent so obtained—as described in the general protocol—the concentrate is prepared with addition of 5000 g of white oil (viscosity=68 $mm^2$/sec).

Mixing in a Concentrate According to the Invention with a Service Fluid for a Technical Layout Thanks to a concentrate according to the invention, the friction between the parts of a technical layout that are moving relative to each other is reduced in reliable manner. The technical layout can be a transmission which is used, for example, in wind power plants, in ships, in motor vehicles or industrial plants. The transmission, which is normally accommodated in a sealed housing, is lubricated with a service fluid. This is, for example, an oil in which the concentrate has been mixed. The agent according to the invention is mixed in with the concentrate, reliably preventing a detachment of the lubricating film on the surfaces of the parts of the technical layout or transmission that are moving relative to each other. This is accomplished in particular by a smoothing of the surfaces, accompanied by a reduction in the coefficient of friction and the steady-state temperature of the transmission parts.

The concentrate according to the invention is mixed in with the lubricating oil already present in the transmission, the concentration of the concentrate being around 2 g per liter of lubricating oil present.

For use in lubricating grease, prior to the mixing process the grease is at first heated to 50° C. to 70° C. After this, 3 g of concentrate per 100 g of grease is mixed in.

In the case of engines, around 6 g of the concentrate according to the invention per liter of cylinder capacity is added to the already present motor oil.

If the oil level in a technical layout is to be influenced as little as possible, the agent according to the invention can be mixed in with a predefined volume of lubricating oil or motor oil removed from the transmission or engine and the concentrate prepared in this way is supplied to the oil remaining in the transmission or engine.

The action according to the invention, especially the smoothing of the surface of the rubbing parts, takes place during the normal operation of the transmission or engine.

For use in a bonded coating, the concentrate is mixed in at 3 wt. % in terms of the weight of the bonded coating base with which the working components of a technical layout that are moving relative to each other are going to be coated afterwards.

Rolling Contact Wear Investigation on the 2Disc Test Stand—Test Duration: 20 h 20 Min By means of a two-disk (2disc) test stand from Optimol-Instruments, Munich, the rolling type of motion was investigated, wherein two disks, 10 mm in width and 45 mm in diameter, were pressed against each other. The concentrates according to the invention per sample embodiments 1 to 3 were added each time at 0.2 wt. % to the conventional oil Agip Blasia 150 (Oil 1). Furthermore, the concentrates according to the invention per sample embodiments 1, 2 and 4 were mixed in each time at 0.2 wt. % with the conventional oil Agip Blasia SX 320 (Oil 2).

The following parameters were chosen:

| | |
|---|---|
| Type of motion: | rolling with 10% slippage |
| Sample body configuration: | disk/disk (line of contact 7 mm) |
| Disk: | each time dia. 45 mm, width 10 mm, ground, average surface roughness $R_z$ around 1.0 μm |
| Max. pressure: | 1496 MPa at 4800 N |
| Speed: | circumferential velocity 5 m/s, 10% slippage, 2108 1/min left shaft, 1897 1/min right shaft |
| Test length: | 20 h 20 min |
| Tempering: | oil temperature const. 85° C., |
| Lubrication: | circulating lubrication without filter |
| Humidity: | around 25-35% rel. h. |
| Measured quantities: | friction force (online), temperature (online) |
| Ramp: | stagewise load increase by 1000 N every 5 min until reaching test load |
| Oil 1: | Agip Blasia 150 (low viscosity ISO VG 150) |
| Oil 2: | Agip Blasia SX 320 (high viscosity ISO VG 320) |

The friction force and the temperature of the sample body were plotted continuously. After a ramp period, a constant temperature of the sample body was measured.

Regardless of whether the experiment was performed with conventional Oil 1 or with conventional Oil 2, it was possible to show that the frictional moment $M_R$ is substantially reduced by adding one of the aforementioned concentrates according to the invention—as compared to the frictional moment for the particular untreated oil (see FIG. 1).

The friction force $F_R$ showed a nearly constant variation when using the two conventional oils 1 and 2.

On the other hand, in the case of Oil 1, especially when adding 0.2 wt. % of the concentrate according to the invention per sample embodiment 1, a distinct decrease in the friction force $F_R$ is observed.

In the case of Oil 2, the adding of 0.2 wt. % of the concentrate according to the invention per sample embodiment 4 resulted in the greatest decrease in the friction force $F_R$.

The corresponding values are listed in Table 2. The frictional coefficient $\mu_{max}$ and $\mu_{min}$ was calculated here as the quotient of the measured friction force $F_R$ and the normal force of 4800 N.

TABLE 2

| Oil | Concentrate per sample embodiment | $T_{sample}$ | $F_{R\,max}$ (t = 0 min) | $\mu_{max}$ (t = 0 min) | $F_{R\,min}$ (t = 20 h 20 min) | $\mu_{min}$ (t = 20 h 20 min) |
|---|---|---|---|---|---|---|
| 1 | — | 103° C. | 433 N | 0.0902 | 390 N | 0.0813 |
| 1 | 1 | 95° C. | 420 N | 0.0875 | 300 N | 0.0625 |
| 2 | — | 95° C. | 325 N | 0.0677 | 282 N | 0.0588 |
| 2 | 4 | 91° C. | 327 N | 0.0681 | 230 N | 0.0479 |

* 0.2 wt. % in terms of the weight of the untreated Oil 1 or 2.

In the lower viscosity Oil 1, the adding of the concentrate according to the invention per sample embodiment 1 shows the most distinct effect. The level of friction here is reduced by around 23% (see FIG. 1, entry 2). The topography measurement by means of white light interferometry shows a distinct smoothing of the surfaces of the loaded sample bodies, as compared to the process with untreated Oil 1.

Also with the higher viscosity Oil 2, substantial improvements are found when adding a concentrate according to the invention, while the concentrates according to the invention per sample embodiments 1 and 4 product similar effects under the test conditions (10% slippage). The level of friction is lowered by around 18% in all three tested concentrates according to the invention thanks to the smoothing of the surfaces (see FIG. 1, entries 6 and 8).

With a white light interferometer, the surface topography of the sample bodies was investigated after the rolling contact wear tests on the 2disc test stand. From the measured values, the roughness parameters of the average surface roughness $R_z$ and mean peak to valley height $R_a$ of the surface were calculated. The corresponding values are listed in Table 3. The data show that the roughness of the surface is distinctly reduced by the adding of the concentrate.

TABLE 3

| Oil | Concentrate per sample embodiment* | $R_z$ (t = 0 min) | $R_z$ (t = 20 h 20 min) | $R_a$ (t = 0 min) | $R_a$ (t = 20 h 20 min) |
|---|---|---|---|---|---|
| 1 | — | 1.01 μm | 0.57 μm | 0.22 μm | 0.12 μm |
| 1 | 1 | 1.01 μm | 0.42 μm | 0.22 μm | 0.09 μm |
| 2 | — | 1.01 μm | 0.70 μm | 0.22 μm | 0.14 μm |
| 2 | 4 | 1.01 μm | 0.45 μm | 0.22 μm | 0.09 μm |

*0.2 wt. % in terms of the weight of the untreated Oil 1 or 2.

The surfaces of the sample bodies were furthermore analyzed by means of scanning electron microscopy after the rolling contact wear tests on the 2disc test stand. FIG. 2 A/2 C and FIG. 2 B show scanning electron microscope photographs of the loaded surfaces of the sample bodies after the run using the conventional Oil 1 (FIGS. 2 A, 2 C) and after the run using the conventional Oil 1 with addition of 0.2 wt. % of the concentrate according to the invention per sample embodiment 1.

The comparison of FIGS. 2 A and 2 C with FIG. 2 B shows that the surface of the sample body after loading with the use of Oil 1 and addition of 0.2 wt. % of the concentrate according to the invention per sample embodiment 1 is much more fine. The striae in the direction of movement are less pronounced. Furthermore, the pits in the material of the sample body are smaller and show no incipient cracks.

FIG. 3 shows that the steady-state temperature of the loaded sample body takes on lower values when a concentrate according to the invention per one of sample embodiments 1 or 2 is added to the conventional Oil 1. In the case of Oil 2, which has higher viscosity than Oil 1, the adding of a concentrate according to the invention per one of sample embodiments 1, 2 or 4 leads to a lowering of the steady-state temperature of the loaded sample body.

On the whole, it can be said that the adding of a concentrate according to the invention per one of the aforementioned sample embodiments under rolling conditions leads to a distinct reduction in the friction and thus—with one exception (see FIG. 3, entry 4)—also in the steady-state temperature of the sample body, as compared to the use of a conventional oil without such an addition.

Rolling Contact Wear Investigation on the 2disc Test Stand—Test Duration: 61 h

With the higher viscosity Oil 2, a lower friction level is fundamentally present from the outset. This indicates that the hydrodynamic component of the mixed friction is higher here, so that the action of a concentrate according to the invention is no longer so distinctly prominent. Therefore, the conditions for the 60-hour test were sharpened by increasing the slippage as compared to the previously described run (20 h 20 min).

By means of a two-disk (2disc) test stand from Optimol-Instruments, Munich, the rolling type of motion was investigated, wherein two disks, 10 mm in width and 45 mm in diameter, were pressed against each other. The concentrate according to the invention per sample embodiment 4 was added at 0.2 wt. % to the conventional Oil 2.

The following parameters were chosen:

| | |
|---|---|
| Type of motion: | rolling with 20% slippage |
| Sample body configuration: | disk/disk (line of contact 8 mm) |
| Disk: | each time dia. 45 mm, width 10 mm, ground, average surface roughness $R_z$ around 2.8 μm |
| Max. pressure: | 1278 MPa at 4000 N |
| Speed: | circumferential velocity 5 m/s, 20% slippage, 2108 1/min left shaft, 1686 1/min right shaft |
| Test length: | 61 h (3 × 20 h 20 min) |
| Tempering: | oil temperature const. 85° C., |
| Lubrication: | circulating lubrication without filter |
| Humidity: | around 25-35% rel. h. |
| Measured quantities: | friction force (online), temperature (online) |
| Ramp: | stagewise load increase by 1000 N every 5 min until reaching test load |
| Oil 2: | Agip Blasia SX 320 (high viscosity ISO VG 320) |

The friction force and the temperature of the sample body were plotted continuously. After a ramp period, a constant temperature of the sample body was measured.

Without adding a concentrate according to the invention, the friction force $F_R$ at first decreases rapidly from 260 N to 235 N. After the first dismantling, 20 h later, the value at around 210 N is distinctly lower. After this, a continuous decrease down to a final value of 180 N is observed (see Table 4).

Upon adding 0.2 wt. % of the concentrate according to the invention per sample embodiment 4 to conventional Oil 2, the friction force $F_R$ and thus also the frictional coefficient μ is substantially reduced as compared to the pure conventional oil (see Table 4). The frictional coefficient $\mu_{max}$ and $\mu_{min}$ was determined here as the quotient of the measured friction force $F_R$ and the normal force of 4000 N.

TABLE 4

| Oil | Concentrate per sample embodiment* | $T_{sample}$ | $F_{R\,max}$ (t = 0 min) | $\mu_{max}$ (t = 0 min) | $F_{R\,min}$ (t = 61 h) | $\mu_{min}$ (t = 61 h) |
|---|---|---|---|---|---|---|
| 2 | — | 125° C. | 260 N | 0.065 | 180 N | 0.045 |
| 2 | 4 | 100° C. | 285 N | 0.071 | 120 N | 0.030 |

*0.2 wt. % in terms of the weight of the untreated Oil 2.

If 0.2 wt. % of the concentrate according to the invention per sample embodiment 4 is mixed in with the conventional Oil 2, the friction force $F_R$ diminishes significantly within the first 6 h. The initial value of the friction force $F_R$ is around 285 N. After a loading period of 5 h, the friction force $F_R$ has already dropped to 145 N. After 16 h, a nearly constant friction force $F_R$ of 120 N has been established.

With a white light interferometer, the surface topography of the sample body was investigated after the rolling contact wear tests on the 2disc test stand. From the measured values, the roughness parameters of the average surface roughness $R_z$ and mean peak to valley height $R_a$ of the surface were calculated. The values were plotted against time (in h) for the run with the conventional Oil 2 and for the run with the conventional Oil 2 with addition of 0.2 wt. % of the concentrate according to the invention per sample embodiment 4 (see FIGS. 4 A and 4 B).

As compared to the run using the untreated Oil 2 (see FIG. 4 A), in the run using an addition of 0.2 wt. % of the concentrate according to the invention per sample embodiment 4 to the conventional Oil 2 the roughness parameters of the surface of the loaded sample body are distinctly reduced (see FIG. 4 B). The reduction in the $R_z$ value and the $R_a$ value occurs essentially within the first 20 h of the overall 60-hour run. After this, the values only change slightly.

In the 60-hour run with the higher viscosity Oil 2 and under sharpened loading conditions (20% slippage), the adding of the concentrate according to the invention per sample embodiment 4 shows a more distinct action than for 10% slippage (see above: remarks on the test duration: 20 h 20 min).

On the whole, the friction level is reduced by around 33%, as compared to the load test using the untreated Oil 2. The steady-state temperature of the sample body decreases from around 125° C. to 100° C., that is, by around 20%. The 60-hour run with the higher viscosity Oil 2 shows that the system is stable after around 16 and has been run in under the given load conditions. There are no signs of an increased wear as compared to the test run with the untreated Oil 2. This is proven by the findings of the scanning electron microscope studies, described further below.

Concomitant with the substantial reduction in friction, the steady-state temperature of the loaded sample body also decreases when the concentrate according to the invention per sample embodiment 4 is added to the conventional Oil 2 (see Table 4). After a loading time of 5 h, the steady-state temperature of the sample body decreases significantly. After 16 h, the steady-state temperature is around 100° C. and thus distinctly below around 125° C., the temperature setting in when using the untreated Oil 2.

Scanning electron microscope photographs of the sample body after 60 h are shown in FIG. 5, where FIG. 5 A shows the surface of the sample body loaded under use of the untreated Oil 2. FIG. 5 B shows the surface of the sample body loaded under use of Oil 2 with addition of 0.2 wt. % of the concentrate according to the invention per sample embodiment 4.

The highly precise representation of the surfaces by means of scanning electron microscope shows the positive smoothing effect of the adding of the concentrates according to the invention per sample embodiment 4 (and 1). Unlike the sample bodies that were loaded while using the pure Oil 2 (see FIG. 5 A), the surface is more fine hours later, it shows smaller flaws and no incipient cracks (see FIG. 5 B).

With changed parameters in the 60-hour test (higher slippage, but somewhat lower pressure), no cracks occur on the surfaces even with the untreated higher viscosity Oil 2. Even so, the surfaces of the sample bodies loaded with use of the Oil 2 and addition of the concentrate according to the invention per sample embodiment 4 are more fine. This smoothing has a positive influence on the friction behavior and thus on the steady-state temperature of the loaded sample body.

It is worthy of mention in this context that a varnishing occurs in the unloaded region in the run with the untreated Oil 2 due to the high temperatures of the sample body, whereas this does not occur in the run with Oil 2 and addition of the concentrate according to the invention per sample embodiment 4.

TÜV-NEFZ Long-Term Testing of Various Automotive Engines Per EURO 5

The NEFZ Test per RL 70/220/EWG revealed, for new-model vehicles of types VW Golf 1.4 TFSI and Ford Mondeo 2.5T with gasoline engines per EURO 5, that the emission of the particle mass or the particle numbers is reduced by the adding of 12 g (VW Golf) or 18 g (Ford Mondeo) of the concentrate according to the invention per sample embodiment 4, by 28% and 41% in the vehicle of type VW Golf and by 46% and 80% in the vehicle of type Ford Mondeo, respectively. The gasoline consumption was reduced by up to 2% as compared to the operation of the vehicles with conventional motor oil without the addition of the concentrate according to the invention.

The invention is not confined to one of the above described embodiments, but rather can be modified in many ways.

It will be recognized that the invention concerns an agent for mixing into a service fluid for a technical layout, a concentrate for mixing into a service fluid for a technical layout, and a service fluid. An agent according to the invention contains at least one ingredient A chosen from the group of three-layer silicates, at least one ingredient B chosen from the group consisting of bentonites, pyrogenic silica, and talc, and graphite.

Thanks to an agent according to the invention, a concentrate according to the invention, and a service fluid according to the invention, the detachment of the lubricating film on the surfaces of working components of a technical layout that are moving relative to each other is prevented in a reliable manner. This is accomplished in particular by a smoothing of the surfaces, accompanied by a reduction of the frictional coefficient and the steady-state temperature of the working components. Moreover, it is ensured that the ingredients of the agent according to the invention, the concentrate according to the invention, and the service fluid according to the invention do not agglomerate, so that they can pass through the filters of the technical layout, such as a wind power plant transmission or an internal combustion engine All features and benefits emerging from the claims, the specification, and the figures, including design features, spatial arrangements, and method steps, can be essential to the invention, both in themselves and in the most diverse combinations.

The invention claimed is:

1. An agent for mixing in with a lubricant for a transmission or a lubricant or fuel for an internal combustion engine containing:

at least one ingredient A chosen from the group of the three-layer silicates, wherein the three-layer silicate is a chemically modified phlogopite, wherein the chemically modified phlogopite is a phlogopite modified with aminosilane, at least one ingredient B consisting of pyrogenic silica, wherein the pyrogenic silica is chemically after-treated, and graphite, wherein the ingredients A and B are contained in relation to each other at a weight ratio of 4.5:1 (72:16) to 1.8:1 (36:20) and wherein the ingredients A and graphite are contained in relation to each other at a weight ratio of 72:1 to 7.2:1 (36:0.5).

2. The agent according to claim 1, characterized by at least one additional ingredient C, chosen from the group consisting of industrial carbon black, organic carbonates, water and dispersant.

3. The agent according to claim 2, characterized in that the organic carbonate is propylene carbonate.

4. The agent according to claim 1, characterized in that ingredients A, B and C have particle sizes less than 25 μm.

5. A concentrate for mixing in with a lubricant for a transmission or a lubricant or fuel for an internal combustion engine, containing a carrier and an agent according to one claim 1, wherein the agent and the carrier are contained in relation to each other at a weight ratio of from 105:1000 to 190:1000.

6. The concentrate according to claim 5, characterized in that the agent is dispersed in the carrier.

7. The concentrate according to claim 5, characterized in that the carrier is the lubricant for a transmission or a lubricant or fuel for an internal combustion engine.

8. A lubricant for a transmission or a lubricant or fuel for an internal combustion engine comprising claim 1.

* * * * *